US009993085B1

(12) United States Patent
Hernandez

(10) Patent No.: US 9,993,085 B1
(45) Date of Patent: Jun. 12, 2018

(54) SHIELDED SEATING ASSEMBLY

(71) Applicant: Joe Hernandez, Santa Maria, CA (US)

(72) Inventor: Joe Hernandez, Santa Maria, CA (US)

( * ) Notice: Subject to any disclaimer, the term of this patent is extended or adjusted under 35 U.S.C. 154(b) by 0 days. days.

(21) Appl. No.: 15/371,576

(22) Filed: Dec. 7, 2016

(51) Int. Cl.

| | |
|---|---|
| ***A47C 9/00*** | (2006.01) |
| ***A47C 9/10*** | (2006.01) |
| ***F41J 5/00*** | (2006.01) |
| ***F41J 5/14*** | (2006.01) |
| ***A63B 63/00*** | (2006.01) |
| ***A47C 7/62*** | (2006.01) |
| ***A47C 3/40*** | (2006.01) |
| ***A47C 5/00*** | (2006.01) |
| ***A63B 71/12*** | (2006.01) |

(52) U.S. Cl.
CPC ..... *A47C 7/62* (2013.01); *A47C 3/40* (2013.01); *A47C 5/00* (2013.01); *A63B 71/12* (2013.01)

(58) Field of Classification Search
CPC .... A47C 7/62; A47C 3/40; A47C 5/00; A63B 71/12
USPC ..... 297/14; 273/381, 383, 402
See application file for complete search history.

(56) References Cited

U.S. PATENT DOCUMENTS 759,809 A * 5/1904 Farley ..... A47C 9/027 297/4
1,355,005 A * 10/1920 Schechter ..... B61D 33/0085 297/14
D140,281 S 4/1944 Weller et al.
D209,048 S 10/1967 Schafer
3,672,672 A * 6/1972 Rubin ..... A63B 69/0097 473/435
3,706,451 A * 12/1972 Dixon ..... A63B 63/00 273/383
3,963,240 A * 6/1976 Tidwell ..... A63B 63/00 273/381
4,009,903 A * 3/1977 Manspeaker ..... A47C 4/06 297/14
4,087,127 A * 5/1978 Lotta ..... A47C 9/06 297/14 X
D279,334 S 6/1985 Agan et al.
4,662,361 A 5/1987 Patterson
4,682,438 A * 7/1987 Arrow ..... B63B 29/04 297/14 X
4,765,617 A * 8/1988 Groves ..... A63B 69/0002 297/209
D297,984 S 10/1988 Osborne
5,185,892 A * 2/1993 Mitchell ..... A47K 3/122 297/14
5,310,242 A * 5/1994 Golder ..... A47D 1/10 297/14
5,547,205 A * 8/1996 do Rosario Sousa de Cabedo ..... B62B 5/085 297/14 X (Continued)

FOREIGN PATENT DOCUMENTS

EP 320199 A1 * 6/1989

*Primary Examiner* — Rodney B White

(57) ABSTRACT

A shielded seating assembly configured to shield a user from projectiles includes a seat. A brace is coupled to a bottom of the seat. The brace is configured to support the seat in a substantially horizontal position above a surface upon which the brace is positioned. A panel is coupled to is the seat and is configured to extend upwardly from the seat and down to the surface upon which the brace is positioned. The panel is configured to shield the user positioned on the seat from projectiles, such as a ball, directed at the panel.

11 Claims, 5 Drawing Sheets

(56) References Cited

U.S. PATENT DOCUMENTS

| | | | | |
|---|---|---|---|---|
| 5,967,255 | A * | 10/1999 | Young | A47B 5/06 297/14 X |
| 6,305,741 | B1 * | 10/2001 | Fernandez | A47C 9/06 297/14 X |
| 6,343,834 | B1 * | 2/2002 | Wurmlinger | A47C 9/06 297/14 X |
| 6,460,922 | B1 * | 10/2002 | Demick | B60N 2/3034 297/14 X |
| 6,698,831 | B2 | 3/2004 | Lloyd | |
| 7,178,868 | B2 | 2/2007 | Richardson et al. | |
| 2016/0008689 | A1 * | 1/2016 | Janeri | A63B 67/06 273/402 |
| 2016/0082334 | A1 * | 3/2016 | Olive | A63B 67/06 273/402 X |
| 2017/0361195 | A1 * | 12/2017 | Singler | A63B 71/022 |

* cited by examiner

SHIELDED SEATING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to seating assemblies and more particularly pertains to a new seating assembly configured to shield a user from projectiles.

BRIEF SUMMARY OF THE INVENTION

An embodiment of the disclosure meets the needs presented above by generally comprising a seat. A brace is coupled to a bottom of the seat. The brace is configured to support the seat in a substantially horizontal position above a surface upon which the brace is positioned. A panel is coupled to is the seat and is configured to extend upwardly from the seat and down to the surface upon which the brace is positioned. The panel is configured to shield the user positioned on the seat from projectiles, such as a ball, directed at the panel.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
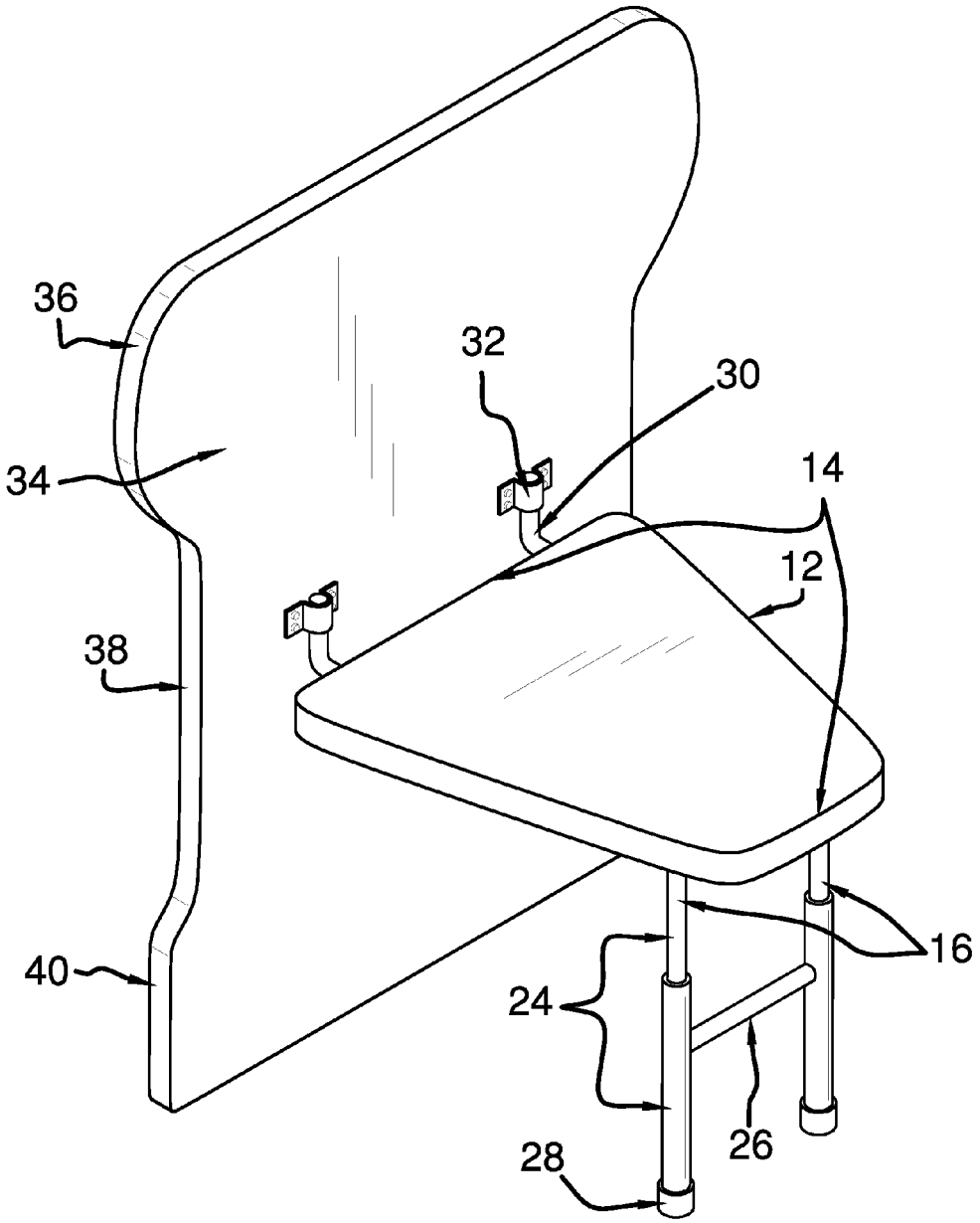
FIG. 1 is an isometric perspective view of a shielded seating assembly according to an embodiment of the disclosure.
Figure 2:
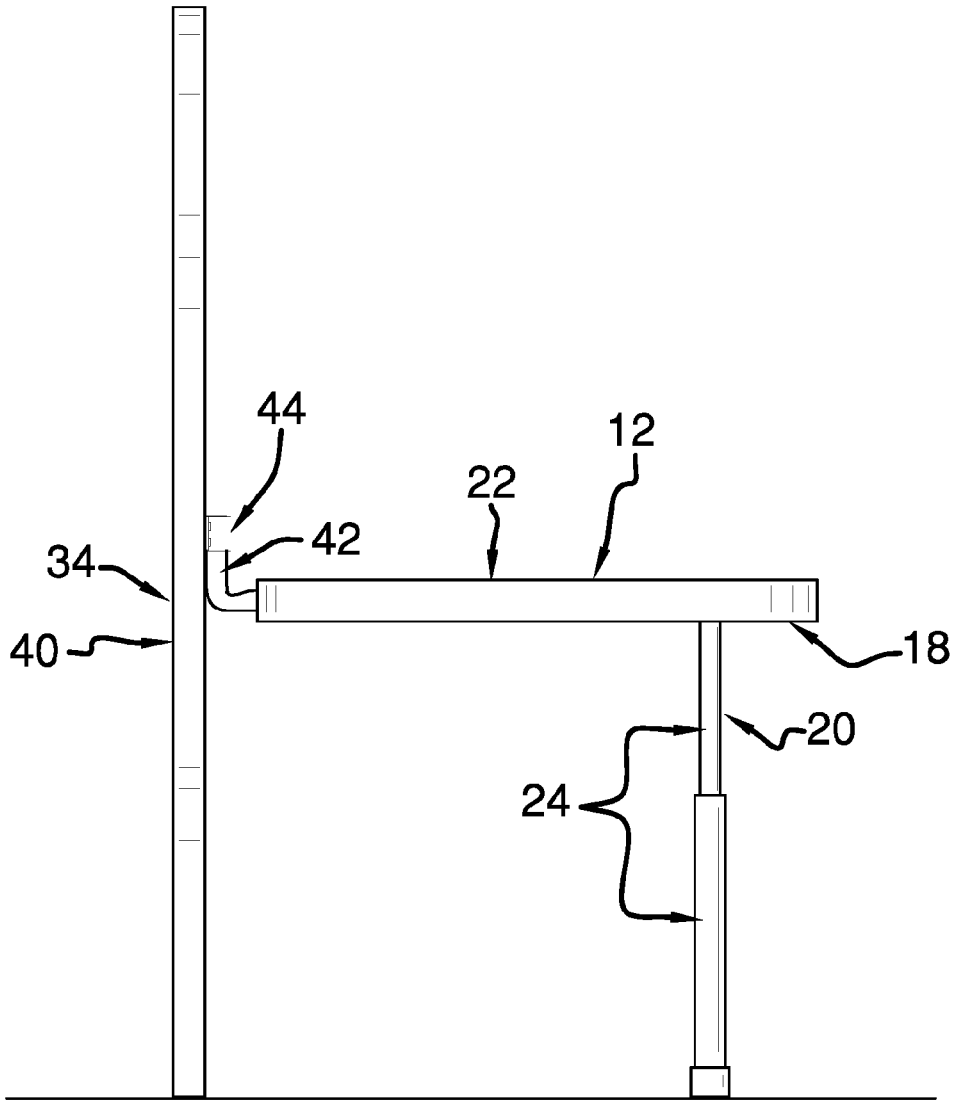
FIG. 2 is a side view of an embodiment of the disclosure.
Figure 3:
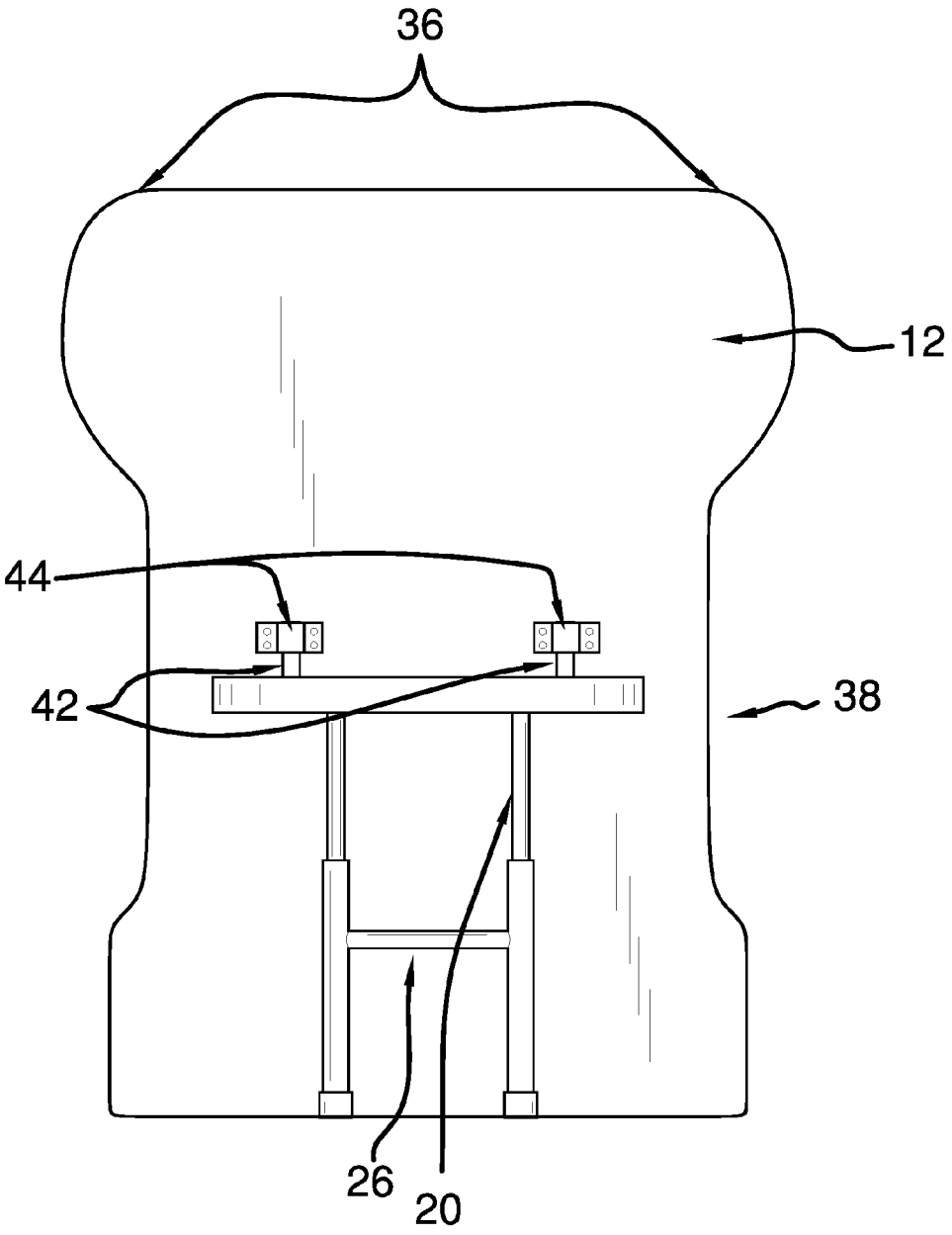
FIG. 3 is a back view of an embodiment of the disclosure.
Figure 4:
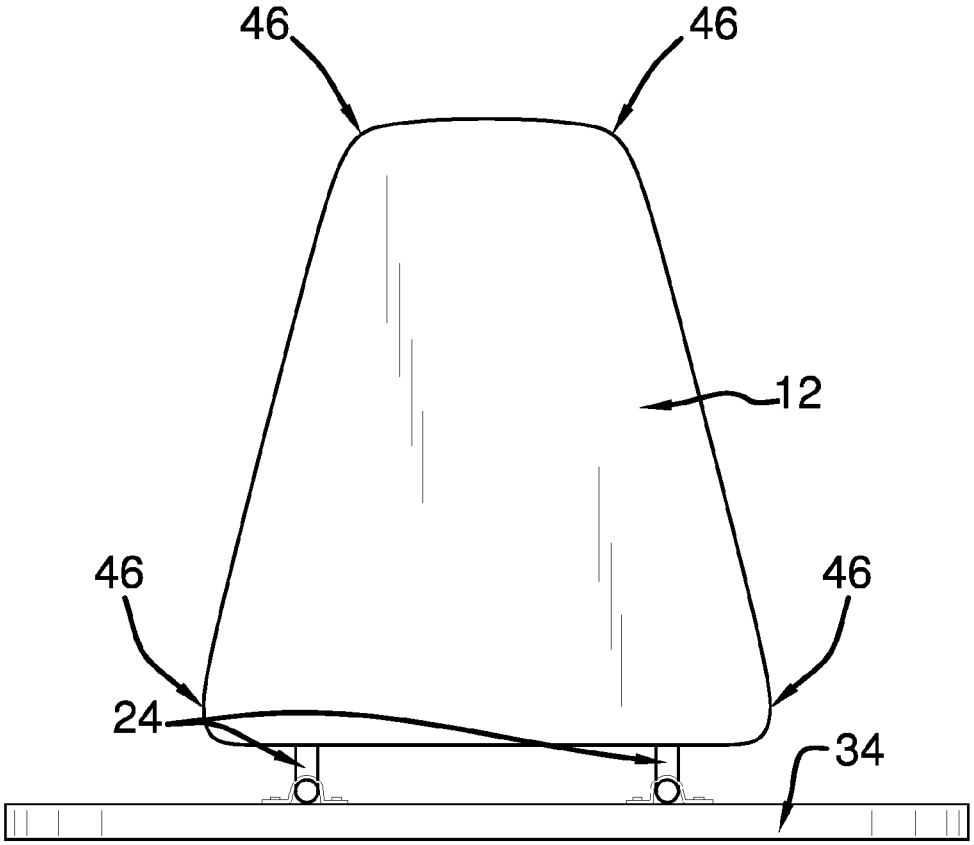
FIG. 4 is a top view of an embodiment of the disclosure.
Figure 5:
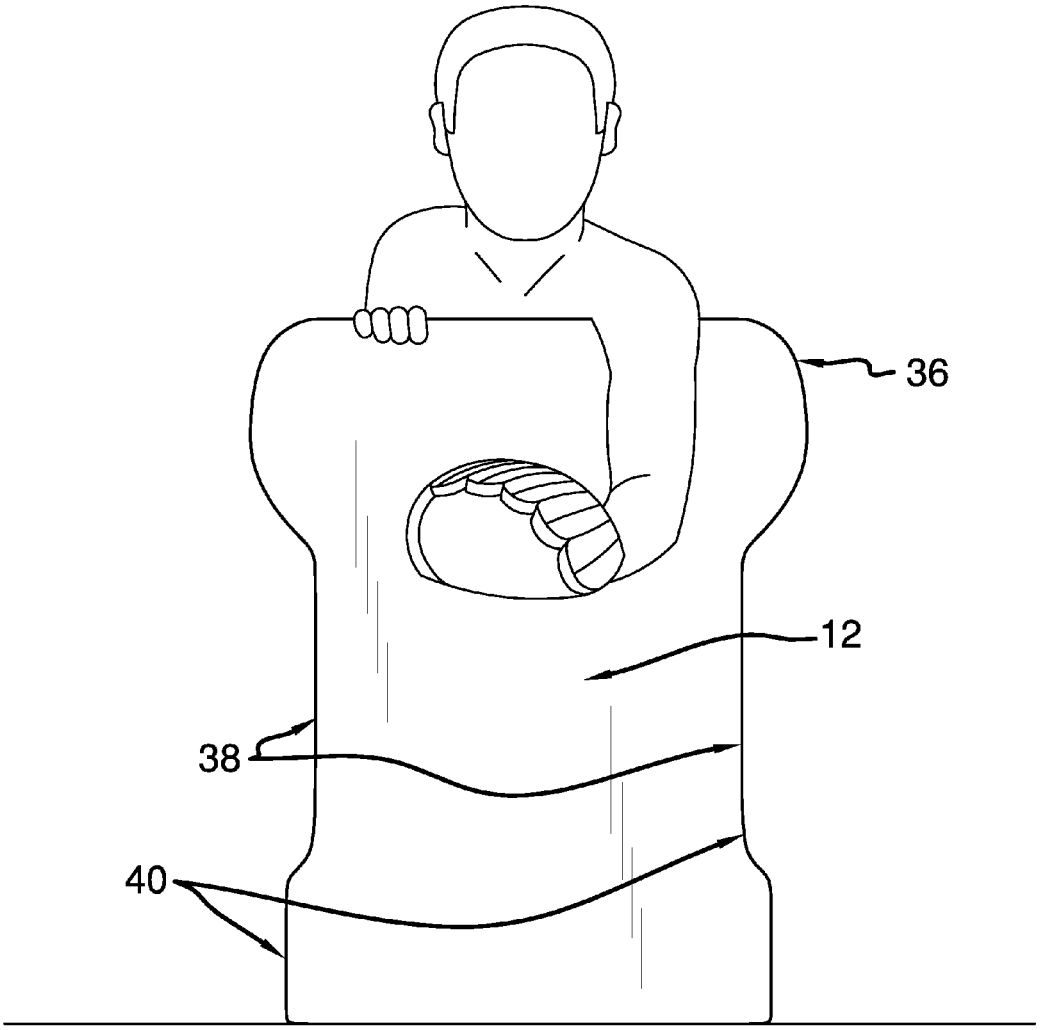
FIG. 5 is an in-use view of an embodiment of the disclosure.

With reference now to the drawings, and in particular to FIGS. 1 through 5 thereof, a new seating assembly embodying the principles and concepts of an embodiment of the disclosure and generally designated by the reference numeral 10 will be described.

As best illustrated in FIGS. 1 through 5, the shielded seating assembly 10 generally comprises a seat 12, which is rigid. The seat 12 has opposing ends 14 that are rounded. A brace 16 is coupled to a bottom 18 of the seat 12. The brace 16 is coupled to the seat 12 such that the brace 16 is configured to support the seat 12 in a substantially horizontal position above a surface upon which the brace 16 is positioned.

In one embodiment, the brace 16 is collapsible. The brace 16 comprises a pair of legs 20 that is hingedly coupled to the bottom 18 of the seat 12 proximate to a respective opposing end 14 of the seat 12. Each leg 20 is positioned proximate to a respective outside edge 22 of the seat 12. In one embodiment each leg 20 comprises a pair of nested sections 24 such that the legs 20 are telescopic. In another embodiment, the brace 16 comprises a pair of feet 28. Each foot 28 is coupled to a respective leg 20 distal from the seat 12. A crossbar 26 is coupled to and extends between the legs 20.

A panel 34 coupled to a respective opposing end 14 of the seat 12. The panel 34 extends substantially perpendicularly from the seat 12 to the surface upon which the brace 16 is positioned. The panel 12 extend upwardly from the seat 12. The brace 16 and the panel 34 are coupled to the seat 12 such that the brace 16 and the panel 34 are configured to support the seat 12 in a substantially horizontal position above a surface. The panel 34 is coupled to the seat 12 such that the panel 12 is configured to shield a user positioned on the seat 12 from projectiles, such as a ball, directed at the panel 34. Each of a pair of second couplers 32 is coupled to the panel 34. The second couplers 32 are complementary to the first couplers 30. The second couplers 32 are 15 positioned on the panel 34 such that the second couplers 34 are positioned to couple to the first couplers 30 to couple the panel 34 to the seat 12.

A pair of cutouts 38 is positioned singly in each of opposing sides 40 of the panel 34. The cutouts 38 are arcuate.

In use, the brace 16 and the panel 34 are coupled to the seat 12 such that the brace 16 and the panel 34 are configured to support the seat 12 in a substantially horizontal position above a surface. The panel 34 is coupled to the seat 12 such that the panel 12 is configured to shield a user positioned on the seat 12 from projectiles, such as a ball, directed at the panel 34, With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A shielded seating assembly comprising:

a seat;

a brace coupled to a bottom of said seat at a first end of said seat, said brace being collapsible, said brace comprising a pair of legs, each of said legs being hingedly coupled to said bottom of said seat proximate to a respective opposing end of said seat, each said leg being positioned proximate to a respective outside edge of said seat, each said leg comprising a pair of nested sections such that said legs are telescopic, and a crossbar coupled to and extending between said legs;

a panel coupled to an opposing second end of said seat, said panel extending substantially perpendicularly from said seat to the surface upon which said brace is positioned, said panel extending upwardly from said seat; and wherein said brace and said panel are coupled to said seat such that said brace and said panel are configured to support said seat in a substantially horizontal position above a surface; wherein said panel is coupled to said seat such that said panel is configured to shield a user positioned on said seat from projectiles directed at said panel.

2. The assembly of claim 1, further including said seat being rigid.

3. The assembly of claim 1, further including said opposing ends and outside edges of said seat defining comers, said corners being rounded.

4. The assembly of claim 1, further including a pair of feet, each said foot being coupled to a respective said leg distal from said seat.

5. The assembly of claim 1, further comprising:

a pair of first couplers, each of said couplers being coupled to a respective one of said first end and said second end of said seat;

a pair of second couplers coupled to said panel, said second couplers being complementary to said first couplers; and wherein said second couplers are positioned on said panel such that said second couplers are positioned to couple to said first coupler to couple said panel to said seat.

6. A shielded seating assembly comprising:

a seat;

a brace coupled to a bottom of said seat at a first end of said seat, said brace being collapsible, said brace comprising:

a pair of legs, each of said legs being hingedly coupled to said bottom of said seat proximate to a respective opposing end of said seat, each said leg being positioned proximate to a respective outside edge of said seat, and a crossbar coupled to and extending between said legs;

a panel coupled to e an opposing second end of said seat, said panel extending substantially perpendicularly from said seat to the surface upon which said brace is positioned, said panel extending upwardly from said seat;

wherein said brace and said panel are coupled to said seat such that said brace and said panel are configured to support said seat in a substantially horizontal position above a surface; wherein said panel is coupled to said seat such that said panel is configured to shield a user positioned on said seat from projectiles directed at said panel;

a pair of feet, each said foot being coupled to a respective said leg distal from said seat; and each said first coupler comprising a pipe, said pipe being right-angled; each said second coupler comprising a tube strap clamp.

7. The assembly of claim 1, further including said panel being rigid.

8. The assembly of claim 7, further including said panel comprising wood.

9. The assembly of claim 1, further including said panel having a pair of upper corners, said upper comers being rounded.

10. The assembly of claim 1, further including a pair of cutouts positioned singly in each of opposing sides of said panel, said cutouts being arcuate.

11. A shielded seating assembly comprising:

a seat, said seat being rigid, said seat having opposing ends and outside edges, said opposing ends and outside edges of said seat defining corners, said comers being rounded, said seat being isosceles trapezoidally shaped;

a brace coupled to a bottom of said seat at a first end of said seat, said brace being collapsible, said brace comprising:

a pair of legs, each of said pair of legs being hingedly coupled to said bottom of said seat proximate to a respective one of said opposing ends of said seat, each said leg being positioned proximate to a respective said outside edge of said seat, each said leg comprising a pair of nested sections such that said legs are telescopic, a crossbar coupled to and extending between said legs, and a pair of feet, each said foot being coupled to a respective said leg distal from said seat;

a pair of first couplers, each of said pair of first couplers being coupled to a respective one of said opposing ends of said seat, said first couplers being positioned singly proximate to said outside edges of said seat, each said first coupler comprising a pipe, said pipe being right-angled;

a pair of second couplers coupled to said panel, said second couplers being complementary to said first couplers, wherein said second couplers are positioned on said panel such that said second couplers are positioned to couple to said first coupler to couple said panel to said seat, each said second coupler comprising a tube strap clamp;

a panel coupled to an opposing second end of said seat, said panel extending substantially perpendicularly from said seat to the surface upon which said brace is positioned, said panel extending upwardly from said seat, wherein said brace and said panel are coupled to said seat such that said brace and said panel are configured to support said seat in a substantially horizontal position above a surface; wherein said panel is coupled to said seat such that said panel is configured to shield a user positioned on said seat from projectiles, such as a ball, directed at said panel, said panel being rigid, said panel comprising wood, said panel having a pair of upper comers, said upper comers being rounded;

a pair of cutouts positioned singly in each of opposing sides of said panel, said cutouts being arcuate; and wherein said brace and said panel are coupled to said seat such that said brace and said panel are configured to support said seat in a substantially horizontal position above a surface; wherein said panel is coupled to said seat such that said panel is configured to shield a user positioned on said seat from projectiles directed at said panel.

* * * * *